US005526924A

United States Patent [19]

Klutznick

[11] Patent Number: 5,526,924

[45] Date of Patent: Jun. 18, 1996

[54] EYEWEAR CASE

[76] Inventor: John F. Klutznick, 2107 Bridgeway, Sausalito, Calif. 94965

[21] Appl. No.: 442,640

[22] Filed: May 17, 1995

Related U.S. Application Data

[63] Continuation of Ser. No. 166,442, Dec. 13, 1993, abandoned.

[51] Int. Cl.[6] ..... A45C 11/04; A45F 5/00; B65D 30/08

[52] U.S. Cl. ..... 206/5.000; 224/250; 383/111

[58] Field of Search ..... 206/5, 5.1, 5 R; 224/253, 901; 383/111

[56] References Cited

U.S. PATENT DOCUMENTS

| | | | |
|---|---|---|---|
| 2,317,302 | 4/1943 | Roth | 224/5 |
| 2,609,854 | 9/1952 | Rosen | 383/111 X |
| 3,050,181 | 8/1962 | Nathan | 206/5 |
| 3,845,799 | 11/1974 | Mittell | 206/5 X |
| 3,938,655 | 2/1976 | Romolt | 206/5 |
| 3,977,516 | 8/1976 | Tilve | 206/5 |
| 4,260,004 | 4/1981 | Domke | 206/316.2 X |
| 4,290,522 | 9/1981 | Takasaki | 206/5 |
| 4,401,209 | 8/1983 | Salmond et al. | 206/5 |
| 4,852,778 | 8/1989 | Beiser et al. | 224/36 X |
| 4,858,800 | 8/1989 | Holtzclaw, Jr. et al. | 224/253 X |
| 4,957,231 | 9/1990 | Kausher | 224/253 X |
| 4,984,682 | 1/1991 | Cummins | 206/5 |
| 4,984,724 | 1/1991 | Johnston | 224/257 |
| 5,052,550 | 10/1991 | Pfenning | 206/5 |
| 5,119,979 | 6/1992 | Kallman | 224/250 |
| 5,188,322 | 2/1993 | Kinstrey | 206/5 X |
| 5,199,621 | 4/1993 | McLennan | 224/253 |
| 5,251,795 | 10/1993 | Jeppesen | 206/5 X |
| 5,325,959 | 7/1994 | Goldberger | 206/5 |
| 5,405,010 | 4/1995 | Goldberger | 206/5 |

FOREIGN PATENT DOCUMENTS

| | | | |
|---|---|---|---|
| 1353002 | 1/1964 | France | 206/5 |

*Primary Examiner*—B. Dayoan
*Attorney, Agent, or Firm*—Welsh & Katz, Ltd.

[57] ABSTRACT

A holder for eyewear such as conventional eyeglasses, sunglasses, sports related eyewear and the like is provided. The holder includes a case having a front panel and rear panel which are attached to each other forming a pocket. A top edge of the front panel and the rear panel form an access opening to the pocket. The rear panel includes a flap adapted to fold over and be removably attached to the top portion of the front panel to cover the opening. Straps for attaching the case to a support may be selectively threaded through one or more of a plurality of sets of parallel slits. One of the set of slits extending at right angles to one of the other set of slits so that the straps may extend from the case in different directions. A gripping arrangement is applied to the case to promote the positive positioning of the case relative to the support.

A cloth sack is removably attached to the case and disposed within the pocket, the sack being configured to fit about the eyewear. The sack is preferably made of a flexible, strong, soft and washable material which is particularly suited to the cleaning of the lenses of the eyewear.

14 Claims, 1 Drawing Sheet

FIG. 1
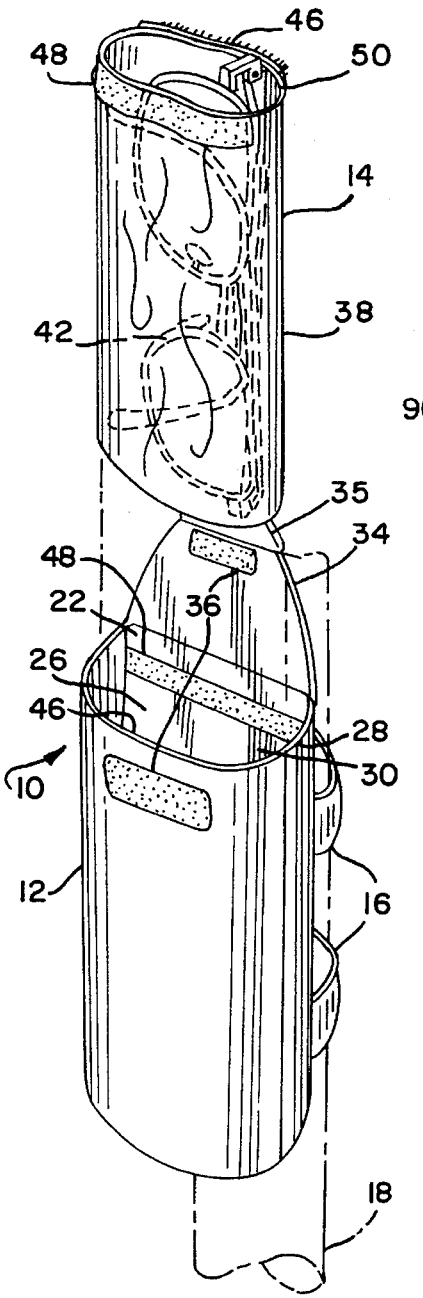
FIG. 2
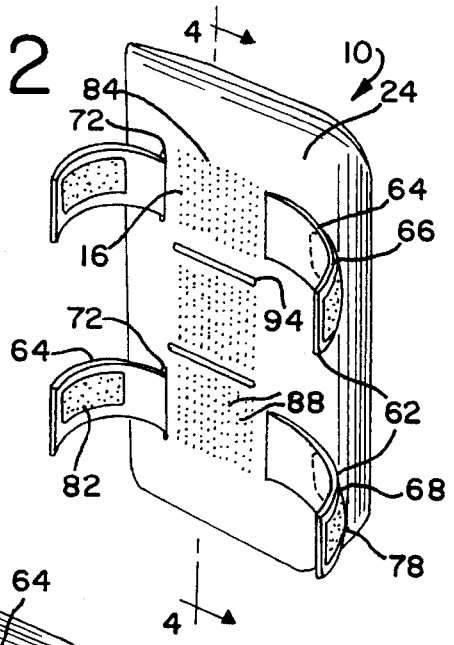
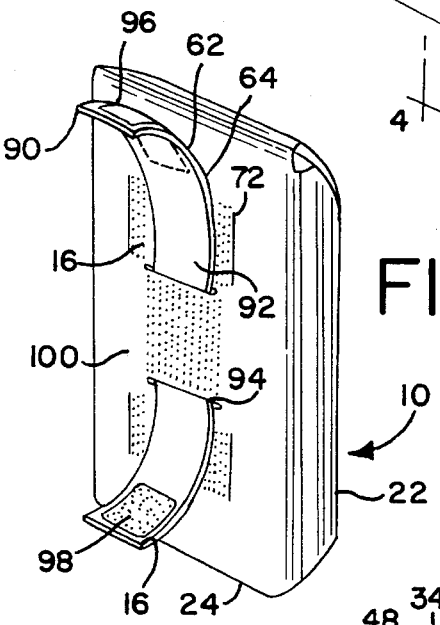
FIG. 3
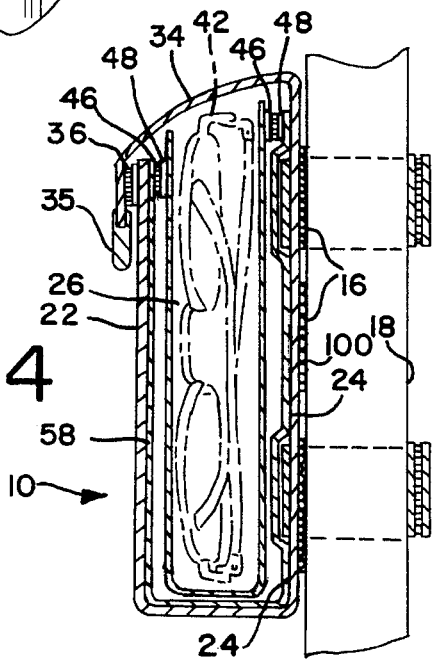
FIG. 4

EYEWEAR CASE

This is a continuation of U.S. patent application Ser. No. 08/166,442, filed Dec. 13, 1993, now abandoned.

FIELD OF THE INVENTION

The present invention relates generally to cases for eyewear and more particularly to a case for eyewear such as conventional eyeglasses, sunglasses, sports related glasses and the like which may be attached in multiple orientations to a carrying structure.

BACKGROUND OF THE INVENTION

Frequently the wearer of eyewear such as sunglasses, conventional eyeglasses, sports related eyewear or the like will need to temporarily store the eyewear. For example, during days of alternative periods of sunshine and cloudiness sunglasses may be alternately worn and stored several times during the course of the day. Therefore, the eyewear should be carried in a manner which allows easy access to the glasses for retrieval and storage of the glasses. It is also preferred that the eyewear be stored in a manner which frees the wearer's hands. Eyewear cases or holders are typically utilized for storage of the eyewear between uses.

During temporary storage, the eyewear should be protected both from environmental elements and impact forces which may fracture the frame or lenses which make up the eyewear. The protection from impact forces may be accomplished by retaining the case in a location where the chance of the impact force striking the case is reduced.

The wearer may be involved in numerous activities such that the available locations where the eyewear holder may be retained changes depending on the activity. For example, when riding a bicycle, the bicycle presents an obvious place on which to attach the eyewear case or holder. However, the user might also be in a situation, such as swimming or sunbathing, where the only available location at which to attach the eyewear case is to the wearer's body. The changing activities and the desire to retain the case in a protected location may require that the same holder be attached in differing orientations to provide access to eyewear within the holder.

The eyewear holder should also be designed such that when the eyewear are disposed within the holder, the eyewear, and particularly the lenses, are protected from abrasion and scratching by the holder.

In addition, during outdoor activity and while the eyewear is being worn, lenses of the eyewear frequently become dirty or spotted from environmental factors such as rain or dust. Therefore, the wearer may also need the ability to clean the lenses. This cleaning may be accomplished by a separate cloth; however, storage of the separate cloth between uses may also present a problem.

It is therefore an object of the present invention to provide a holder for eyewear such as conventional eyeglasses, sunglasses, sports related eyewear and the like.

Another object of the present invention is to provide an eyewear holder which protects eyewear during storage of the eyewear.

It is a further object of the present invention to provide an eyewear holder which may be attached to a number of different supports in various orientations relative to the supports.

It is still a further object of the present invention to provide an eyewear holder which includes a means for cleaning the lenses of the eyewear.

SUMMARY OF THE INVENTION

Accordingly, a holder for eyewear is provided. The holder includes a case having a front panel and rear panel which are attached to each other forming a pocket. A top edge of the front panel and the rear panel form an access opening to the pocket. The rear panel includes a flap adapted to fold over and be removably attached to a top portion of the front panel to cover the opening. The rear panel of the case has a plurality of sets of parallel slits, one of the set of slits being angled to one of the other set of slits. A strap for removably attaching the case to a support is threaded through at least one the set of slits with one end of the strap having a complementary hook section and the other end having complementary loop section so that the ends of the strap may be selectively attached to each other.

A cloth sack is removably attached within the pocket of the case with the sack and case configured to fit about the eyewear. The sack is preferably made of a material which is particularly suited to the cleaning of the lenses of the eyewear. The material should also be strong, flexible, washable and quick drying.

BRIEF DESCRIPTION OF THE DRAWINGS

FIG. 1 is an exploded perspective view of a eyewear holder embodying the present invention;

FIG. 2 is a rear view of the holder of FIG. 1 illustrating a first strapping arrangement;

FIG. 3 is a rear view of the holder of FIG. 1 illustrating a alternate strapping arrangement; and FIG. 4 is a side sectional view of the holder of FIG. 1 taken generally along the line 4—4 in FIG. 2 and in the direction generally indicated and illustrating the holder disposed about a support.

DESCRIPTION OF THE PREFERRED EMBODIMENTS

Referring to FIGS. 1–4, there is illustrated an eyewear holder of the present invention, generally designated at 10. Generally, the holder 10 includes an outer case 12, a removable insert 14 disposed within the case and an arrangement 16 for attaching the holder 10 in various orientations to various supports 18, such as the illustrated tubular structure.

The case 12 includes a generally rectangular front panel 22 which is juxtaposingly arranged with a similarly sized and configured rear panel 24. The front and rear panels 22, 24 are attached about their side and bottom edges to form a pocket 26. A top edge 28 of the front panel 22 and rear panel 24 are unattached to form an opening 30 so that the pocket 26 may be accessed. The opening 30 may be selectively covered by a flap portion 34 of the rear panel 24. Preferably the flap 34 has a semicircular periphery and folds over the top portion of the front panel 22, and the outer tip of the flap is covered with a rubber like protective covering 35.

The flap 34 may be selectively attached to the front panel 22 by a hook and loop attaching arrangement 36 so that the flap may be easily detached for access to the opening 30 and then reattached. In the preferred embodiment, the case 12 is composed of a strong flexible material such as nylon mesh or CORDURA nylon cloth or the like. The protective covering 35 about the tip prevents fraying of the case material and also provides a surface so that the flap may be easily grasped particularly when the user is wearing gloves.

The insert 14 is removably attached to the case 12 and typically located within the pocket 26. The insert 14 includes a sack 38 preferably made of flexible cloth which is adapted to fit about eyewear 42, such as conventional eyeglasses, sunglasses, sports related eyewear and the like. The case 12 is sized to allow the sack 38 and contained eyewear 42 to be inserted into and carried within the pocket 26. The sack 38 preferably forms a rectangular periphery and is dimensioned to be slightly less than the dimensions of the pocket 26.

To attach the sack 38 to the case 12, complementary strips of hook 46 and loop 48 material are stitched to the interior of the case 12 in close proximity to the top edge 28 and also to the sack 38 in close proximity to the top edge 50 of the sack. To allow easy insertion of the eyewear 42 into the pocket 26, the top edge 50 of the sack is retained in an open position by extending the strips 46 and 48 hook and loop material about the top edge 50 of the sack 38 and laterally across the interior of the front and rear panels 22 and 24, slightly below the top edge 28. The sack 38 is preferably made of a soft material or fabric which is also strong, flexible, washable, quick drying and does not scratch eyewear lenses. The fabric is preferably a type of soft material which is particularly suited to cleaning lens such as MICRO-CLEAR® manufactured by Oakley of Irvine, Calif.

Referring specifically to FIG. 4, in addition the interior surfaces of the front panel 22 and rear panel 24 may be lined with a protective fabric layer 58 such as felt, fleece or the like which acts as a shock absorber to protect the eyewear 42 from impact forces. The fabric layer 58 may also prevent the front panel 22 or rear panel 24 from scratching the lenses of the eyewear in the event the insert 14 is not disposed in the pocket 26.

Referring back to FIGS. 1–4, for attaching the case 12 in alternate orientations to supports 18 of various configurations, the fastening arrangement 16 includes two sets of straps 62 which extend through the case at right angles to each other and will typically be used alternately to removably attach the case 12 to the support 18. The straps 62 include a first set 64 which extends in a lateral direction through the case 12. The first set 64 includes an upper strap 66 which is looped through the case 12 in the upper portion of the rear panel 24 and a lower strap 68 in the lower portion of the rear panel. The first set 64 is removably attached to the case 12 by being looped through corresponding sets of longitudinally extending parallel slits 72 formed in the rear panel 24 of the case. The strips in the first set 64 are configured to be affixed to each other after the strips have been extended generally about the support 18 as illustrated in FIG. 1. To removably attach the lateral strap 64 about the support structure 18, complementary strips of hook 78 and loop 82 material are attached to opposing ends of the straps in the first set 64.

An arrangement of gripping structures 84 is applied or attached to the rear panel 24 and disposed between the pair of slits 72 to provide for frictional gripping of the case 12 to the support 18 at those locations where the case typically contacts the support. This gripping is important to maintain the position of the holder 10 about a rod or tubular support 18 particularly when the support has a smooth surface. In addition, the gripping structures 84 prevent the scratching or marring of the support surface. The gripping structures 84 are preferably raised dots or bumps 88 composed of a polymeric material which are directly attached or printed on the rear panel 24 between the parallel slits 72. The gripping bumps 88 are preferably of the type manufactured by the Manzella Company of Buffalo, N.Y. Alternately, the raised bumps 88 may be formed on a separate planar backing which may then be attached to the rear panel 24.

To removably attach the case 12 to a support 18 which extends laterally relative to the case 12, the straps 62 include a second set of straps 90 which has at least one longitudinally extending strap 92. The strap 92 is removably attached to the rear panel 24 of the case 12 by looping through a set of coparallel laterally extending slits 94 in the rear panel 24. The longitudinal strap 92 may be removably attached about the support 18 by means of a hook and loop arrangement with hook material 96 attached to one end of the strap and the cooperating loop material 98 attached to the opposing end of the strap. To provide frictional gripping between the case and the support 18, gripping structures 100 similar to the gripping structures 84 may be applied or attached to the rear panel 24 between the slits 94. To prevent tearing of the rear panel 24 by forces applied to the panel by the first set of straps 62 and longitudinally extending strap 92, the slits 72 and 94 are preferably reinforced.

The lateral straps 64 and longitudinal strap 92 may be of various lengths so that the case 12 may be attached to supports of different thicknesses. For example, short straps are preferable to attach the holder 10 to such an article as a bicycle frame or a backpack frame while a long strap is preferable to attach the holder about the user's waist.

In an alternate arrangement, the gripping arrangements are attached to planar backings and the planar backings then attached to the rear panel 24 to form belt retention loops. The longitudinal straps 92 and lateral straps 64 may be threaded through the loops and between the planar backing and rear panel 24 to removably attach the longitudinal straps and lateral straps to the case 12.

Referring to FIG. 1, in use the sack 38 is attached to the case 12 and disposed within the pocket 26 formed by the front panel 22 and rear panel 24 of the case 12. To place eyewear 42 in the sack 38 or remove the eyewear from the sack, the flap 34 is detached from the front panel 22. If the eyewear 42 needs to be cleaned, the insert 14 may be detached from the case 12 and the sack 38 used to clean the lens of the eyewear 42. The sack 38 may then be reattached to the case 12.

Depending on the desired orientation of the holder 10 relative to the support 18, one or both of the lateral straps 64, or alternately the longitudinal strap 92, may be looped through the longitudinal or lateral slits 72, 94, respectively, in the rear panel 24. The ends of the straps 64, 92 may then be looped about the support 18 and attached to each other. To prevent the marring and scratching of surfaces or the sliding of a holder 10 relative to the support 18, particularly in those instances where a support has a smooth surface, the gripping structures 84, 100 contact and grip the surface of the support and prevent relative movement between the holder 10 and support.

A specific embodiment of the novel eyewear case according to the present invention has been described for the purposes of illustrating the manner in which the invention may be made and used. It should be understood that implementation of other variations and modifications of the invention in its carious aspects will be apparent to those skilled in the art, and that the invention is not limited by the specific embodiment described. It is therefore contemplated to cover by the present invention any and all modifications, variations, or equivalents that fall within the true spirit and scope of the basic underlying principles disclosed and claimed herein.

What is claimed is:

1. A holder for eyewear comprising:

a case in combination with eyewear, the case having a flexible, generally rectangular front panel and rear panel having a top edge, a bottom edge and two side edges, said bottom edges and said side edges of said front panel and said rear panel being attached to each other to form a pocket, said bottom edges being shorter than said side edges, said top edges being separated from each other to form an access opening to said pocket;

a flexible cloth sack within said pocket, said sack being attached to said case only around said opening; and an arrangement disposed on the rear panel for removably attaching the holder in various orientations to a support.

2. The holder of claim 1 wherein the arrangement for attaching further comprises strap for removably attaching the case to the support, said strap being removably attached to said case.

3. The holder of claim 2 including a gripping means disposed on said rear panel, wherein said strap means includes at least one strap, said strap being threaded between a pair of slits in said rear panel.

4. The holder of claim 3 wherein said strap extends generally parallel to said bottom edges.

5. The holder of claim 3 wherein said gripping means includes a plurality of raised polymeric dots.

6. The holder of claim 5 wherein said dots are generally circular.

7. The holder of claim 1 wherein the sack is composed of a flexible, strong and washable fabric.

8. The holder of claim 1 wherein the sack has a top edge, the holder further including means for removably attaching the top edge of the sack to a location on the inner surface of holder adjacent the opening, the attaching means including complementary hook and loop attachment sections.

9. The holder of claim 1 wherein the rear panel includes a flap adapted to fold over a top portion of the front panel to cover the opening, the flap being removably attached to the front panel.

10. The holder of claim 1 further including strap means attached to the case for removably attaching the case to a support.

11. A holder for eyewear comprising:

a case in combination with eyewear, the case having a flexible, generally rectangular front panel and rear panel having a top edge, a bottom edge and two side edges, said bottom edges and said side edges of said front panel and said rear panel being attached to each other to form a pocket, said bottom edges being shorter than said side edges, said top edges being separated from each other to form an access opening to said pocket;

a flexible cloth sack within said pocket, said sack being attached to said case only around said opening;

means for retaining the holder in various orientations to a support;

a planar backing layer attached to said rear panel, and having gripping means attached to an outer surface thereof, wherein said layer including at least one slit said retaining means includes at least one strap, said strap being threaded between said layer and said rear panel.

12. The holder of claim 11 wherein said sack is attached to said case only about said opening.

13. The holder of claim 11 wherein the means for retaining further comprises at least two orthogonal pairs of coplanar attachment slits in the rear panel.

14. The holder of claim 1 wherein the means for retaining further comprises at least two orthogonal pairs of coplanar attachment slits in the rear panel.

* * * * *